US006681018B1

(12) United States Patent
Asakura et al.

(10) Patent No.: US 6,681,018 B1
(45) Date of Patent: Jan. 20, 2004

(54) AUDIO SIGNAL PROCESSOR AND AUDIO DEVICE

(75) Inventors: Keiichi Asakura, Tokyo (JP); Shigeharu Watanabe, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/508,234

(22) PCT Filed: Jul. 9, 1999

(86) PCT No.: PCT/JP99/03733

§ 371 (c)(1),
(2), (4) Date: Oct. 24, 2000

(87) PCT Pub. No.: WO00/03562

PCT Pub. Date: Jan. 20, 2000

(30) Foreign Application Priority Data

Jul. 9, 1998 (JP) ..... P10-194581

(51) Int. Cl.[7] ..... H04R 5/00
(52) U.S. Cl. ..... 381/18; 381/27; 381/119
(58) Field of Search ..... 381/17, 18, 19, 381/20, 21, 22, 23, 27, 119

(56) References Cited

FOREIGN PATENT DOCUMENTS

| | | | |
|---|---|---|---|
| JP | 3-85831 | * | 4/1991 |
| JP | 9-200897 | * | 7/1997 |

* cited by examiner

*Primary Examiner*—Minsun Oh Harvey
(74) *Attorney, Agent, or Firm*—Jay H. Maioli

(57) ABSTRACT

An audio signal processing apparatus includes an input unit to which at least an audio signal of a left channel, an audio signal of a right channel, and an audio signal of a center channel are supplied, a first output terminal unit for outputting the audio signal of the left channel, the audio signal of the right channel, and the audio signal of the center channel which are supplied to the input unit, a mixing unit for mixing the audio signal of the center channel to the audio signal of the left channel and mixing the audio signal of the center channel to the audio signal of the right channel to output the mixed signals as audio signals of two channels, and a second output terminal unit for outputting the audio signals of the two channels from the mixing unit.

8 Claims, 3 Drawing Sheets

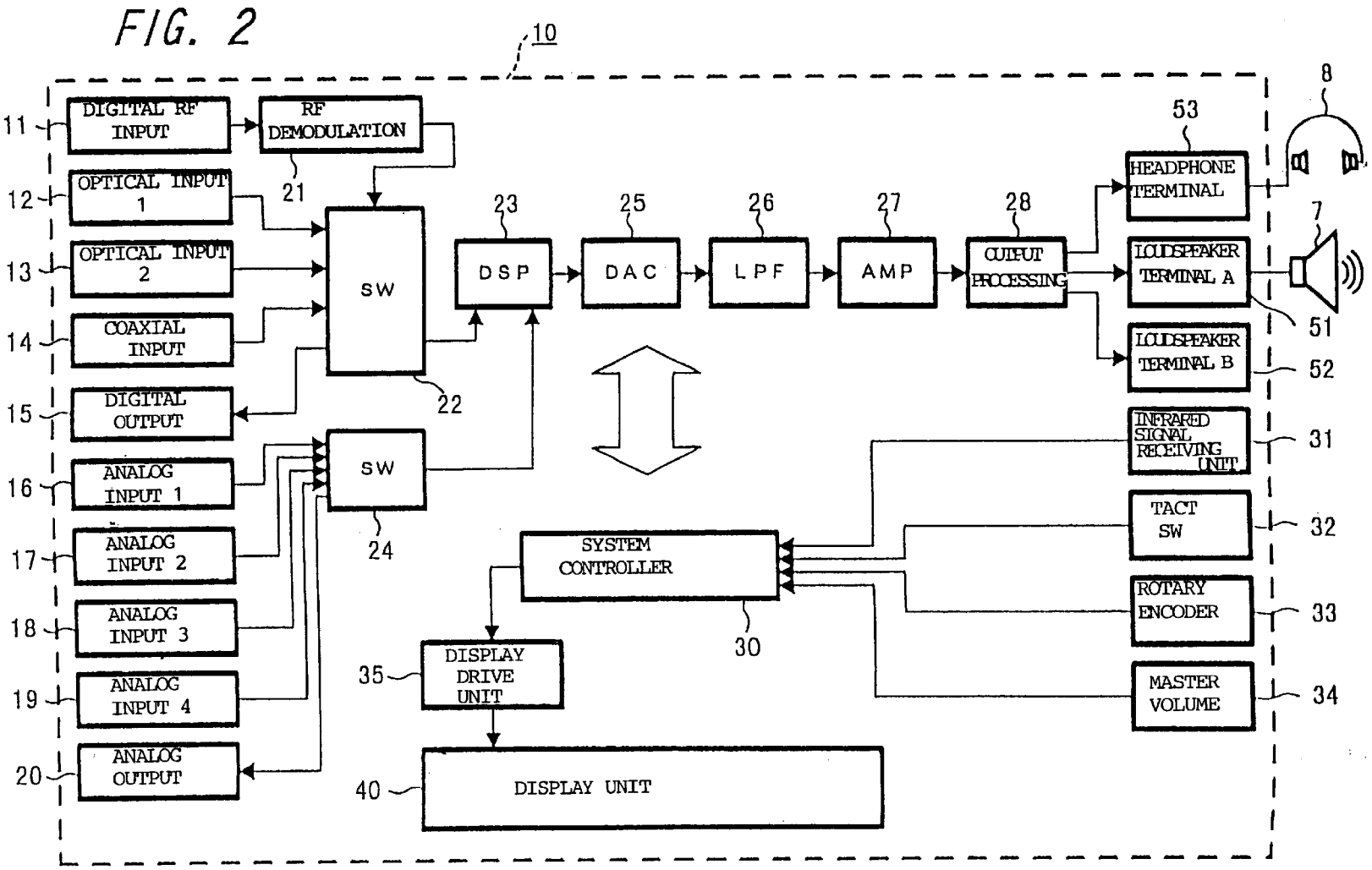
FIG. 2
10
DIGITAL RF INPUT
11
OPTICAL INPUT 1
12
OPTICAL INPUT 2
13
COAXIAL INPUT
14
DIGITAL OUTPUT
15
ANALOG INPUT 1
16
ANALOG INPUT 2
17
ANALOG INPUT 3
18
ANALOG INPUT 4
19
ANALOG OUTPUT
20
RF DEMODULATION
21
SW
22
SW
24
DSP
23
DAC
25
LPF
26
AMP
27
OUTPUT PROCESSING
28
HEADPHONE TERMINAL
53
LOUDSPEAKER TERMINAL A
51
LOUDSPEAKER TERMINAL B
52
INFRARED SIGNAL RECEIVING UNIT
31
TACT SW
32
ROTARY ENCODER
33
MASTER VOLUME
34
SYSTEM CONTROLLER
30
DISPLAY DRIVE UNIT
35
DISPLAY UNIT
40
8
7

8
10
53
53L
53R
52
52L
52R
51
51L
51C
51R
51LFE
51SL
51SR
7R'
7L'
7R
7C
7L
7SW
7SL
7SR
SW
59L
59R
27HL
27HR
27L
27C
27R
27LFE
27SL
27SR
58R
58L
57L
57R
56L
56R
55L
55R
54L
54R
54C
54LFE
54SL
54SR
50L
50C
50R
50LFE
50SL
50SR

AUDIO SIGNAL PROCESSOR AND AUDIO DEVICE

TECHNICAL FIELD

The present invention relates to an audio signal processing apparatus and an audio apparatus. In particular, the present invention relates to an audio signal processing apparatus and an audio apparatus for supplying a multi-channel audio signal.

BACKGROUND ART

Conventionally, an amplifier apparatus, connected to a reproduction apparatus serving as an audio signal source, for performing a process such as amplification to an audio signal supplied from the reproduction apparatus side, and for supplying the processed audio signal to a loudspeaker apparatus connected to the amplifier apparatus to output a sound, an apparatus called an AV amplifier apparatus (abbreviation of an audio visual center amplifier apparatus) is known. The AV amplifier apparatus is a multi-functional audio device for performing an advanced process of audio signals synchronized with video images (audio signals which are not related to the video images may be input), and is designed such that a sound field, sound quality, and the like can be set in arbitrary states.

In this AV amplifier apparatus, as audio signals to be input, in addition to an ordinary two-channel stereo audio signal, audio signals, called multi-channel audio signals, of five channels may be input. For example, audio signals of total of six channels, i.e., a front left channel, a front right channel, a center channel, a rear left channel, and a rear right channel, and a low-band dedicated channel may be input. In such a channel configuration, the low-band dedicated channel is regarded as 0.1 channel, and this channel and the five channels may be called 5.1 channels. The signal of the low-band dedicated channel is an audio signal whose band is lower than, e.g., about 120 Hz, and the signal is supplied and output to a loudspeaker apparatus, called a super woofer, for reproducing a low-band sound. When the super woofer is not used, the signal is mixed to the signals of the other channels, the signal of the low-band dedicated channel is reproduced from loudspeaker apparatuses for the other channels together with the other channels. The channels other than the low-band dedicated channel are supplied to the loudspeaker apparatuses arranged at respective positions in a room as respective channels, for example, a plurality of loudspeaker apparatuses are arranged around a listener, so that a stereophonic space is formed.

Such an AV amplifier apparatus comprises, in addition to terminals for connecting a plurality of loudspeaker apparatuses, a terminal for connecting a headphone apparatus. As described above, audio signals may be output from the plurality of loudspeaker apparatuses, and audio signal can also be output from the headphone apparatuses.

The audio signals output from the headphone terminal of the AV amplifier apparatus described above are signals of two channels, i.e., a front left channel and a front right channel. For example, the audio signals of the two channels are supplied to the AV amplifier apparatus, and a sound based on the audio signals of two front left and right channels is output from at least one pair of loudspeaker apparatuses, connected to the AV amplifier apparatus, for the front left and right channels. In this setting, a sound output from the headphone apparatus connected to the headphone terminal of the AV amplifier apparatus is basically set in the same state as that of the sound output from the loudspeaker apparatuses described above.

However, in a state in which five-channel, i.e., multi-channel audio signals are input to an AV amplifier apparatus, in a setting in which a sound based on the supplied multi-channel audio signals is output from the multi-channel loudspeaker apparatuses, connected to the AV amplifier apparatus, for the respective channels, a sound output from the headphone apparatus connected to the headphone terminal of the AV amplifier apparatus is constituted by only the sounds of the two front channels of the sounds of the five channels constituting the multi-channel audio. As a result, a user using the headphone apparatus listens to only the sounds of some channels of, e.g., the five channels.

More specifically, when the multi-channel audio signals of 5.1 channels described above is input to the AV amplifier apparatus as audio signals of a movie, voice of speech (words) synchronized with moving pictures of the movie is mainly included in the center channel, and only a sound such as music is output from the left and right loudspeaker apparatuses by the signals of the two front left and right channels. In this case, only a sound (music in the above example) included in the two front left and right channels is output from the headphone apparatus connected to the AV amplifier apparatus, words of the movie included in the center channel cannot be heard. The user cannot hear various sound effects or the like included in the rear channels of the 5.1 channels by means of the headphone apparatus.

In order to solve this problem, for example, when the headphone apparatus is connected, a setting is preferably made such that the process of converting multi-channel audio into two-channel audio in the AV amplifier apparatus is performed. However, in this setting, a sound output from the stationary loudspeaker apparatus connected to the AV amplifier apparatus is also of two-channel audio obtained by converting the multi-channel audio.

Therefore, when appropriate multi-channel audio is heard by using a headphone apparatus in a conventional AV amplifier apparatus, not only switching of a switch for turning off the stationary loudspeakers is simply performed, an operation for setting the processing state of multi-channel audio by a mode setting must be performed. When the state in which the headphone apparatus is used is returned to the state in which the stationary loudspeaker apparatus are used, an operation of returning the state to the original setting state must be performed. A problem that the operation is very complex is posed.

DISCLOSURE OF THE INVENTION

It is an object of the present invention to make it possible that an outputting operation of multi-channel audio signals from a loudspeaker apparatus and an outputting operation of the signals from a headphone apparatus are preferably performed.

In the first invention, an audio signal processing apparatus comprises, an input unit to which at least an audio signal of a left channel, an audio signal of a right channel, and an audio signal of a center channel are supplied, a first output terminal unit for outputting the audio signal of the left channel, the audio signal of the right channel, and the audio signal of the center channel which are supplied to the input unit, a mixing unit for mixing the audio signal of the center channel to the audio signal of the left channel and mixing the audio signal of the center channel to the audio signal of the right channel to output the mixed signals as audio signals of two channels, and a second output terminal unit for outputting the audio signals of the two channels from the mixing unit. In this manner, the audio signal of the left channel, the audio signal of the right channel, and the audio signal of the center channel are independently output from the output terminal unit, and the audio signals of the two channels obtained by mixing a signal component of the center channel to the audio signal of the left channel and the audio signal of the right channel are output from the second output terminal unit, so that the audio signals of two different types of channel forms can be output from one audio signal processing apparatus. For example, the first output terminal unit is connected to a stationary loudspeaker apparatus, and the second output terminal unit is connected to a headphone apparatus, so that an outputting operation of an audio signal of a channel form being appropriate to the stationary loudspeaker apparatus and an outputting operation of an audio signal of a channel form being appropriate to the headphone apparatus can be properly performed by selection of the output terminal units.

In the second invention, in the audio signal processing apparatus according to the first invention, the audio signal processing apparatus further comprises a switching unit for selectively supplying the audio signal of the left channel and the audio signal of the right channel supplied to the second output terminal unit through the input unit and the audio signals of the two channels from the mixing unit. In this manner, a switching operation between the state in which the outputting operation of the audio signal which is mixed with the audio signal of the center channel is performed, and the state in which the outputting operation of the audio signal which is not mixed with the audio signal of the center channel can be easily performed by operating the switching unit.

In the third invention, in the audio signal processing apparatus according to the second invention, the switching unit selectively supplies the audio signal of the left channel and the audio signal of the right channel supplied to the first output terminal unit through the input unit and the audio signals of the two channels from the mixing unit. In this manner, the audio signal of the left channel and the audio signal of the right channel supplied to the first output terminal unit can be easily output from the second output terminal unit by a switching operation of the switching unit.

In the fourth invention, an audio apparatus comprises an input unit to which at least an audio signal of a left channel, an audio signal of a right channel, and an audio signal of a center channel are supplied, a first output terminal unit, to which a plurality of loudspeaker apparatuses are connected, for outputting at least the audio signal of the left channel and the audio signal of the right channel of the audio signal of the left channel, the audio signal of the right channel, and the audio signal of the center channel supplied to the input unit, a mixing unit for mixing the audio signal of the center channel to the audio signal of the left channel and mixing the audio signal of the center channel to the audio signal of the right channel to output the mixed signals as audio signals of two channels, and a second output terminal unit to which the audio signals of the two channels from the mixing unit and to which a headphone apparatus is connected. In this manner, the audio signal of the left channel, the audio signal of the right channel, and the audio signal of the center channel are independently supplied to a plurality of loudspeaker apparatuses connected to the first output units, and the audio signals of the respective channels are independently output from the loudspeaker apparatuses. The signals obtained by mixing the audio signal of the center channel to the audio signal of the left channel and the audio signal of the right channel are supplied to the headphone apparatus connected to the second output terminal unit, and the audio signals including the center channel are output from the headphone apparatus.

In the fifth invention, in the audio apparatus according to the fourth invention, the audio apparatus further comprises a switching unit for selectively supplying the audio signal of the left channel and the audio signal of the right channel supplied to the second output terminal unit through the input unit and the audio signals of the two channels from the mixing unit. In this manner, a switching operation between the state in which the outputting operation of the audio signal which is mixed with the audio signal of the center channel from the headphone apparatus connected to the second output terminal unit is performed, and the state in which the outputting operation of the audio signal which is not mixed with the audio signal of the center channel can be easily performed by operating the switching unit.

In the sixth invention, in the audio apparatus according to the fifth invention, the switching unit selectively supplies the audio signal of the left channel and the audio signal of the right channel supplied to the first output terminal unit through the input unit and the audio signals of the two channels from the mixing unit. In this manner, the audio signal of the left channel and the audio signal of the right channel supplied from the first output terminal unit to the loudspeaker apparatuses can be easily output from the second output terminal unit to the headphone apparatus by a switching operation of the switching unit.

In the seventh invention, in the audio apparatus according to the fourth invention, the first output terminal unit comprises a first output unit for outputting at least the audio signal of the left channel and the audio signal of the right channel of the audio signal of the left channel and the audio signal of the right channel supplied to the input unit and the audio signal of the center channel, and a second output unit for respectively outputting the audio signal of the left channel, the audio signal of the right channel, and the audio signal of the center channel supplied to the input unit. In this manner, loudspeaker apparatuses can be independently connected to the first output unit and the second output unit, and a channel configuration of the loudspeaker apparatuses respectively connected to the output unit can be changed.

In the eighth invention, in the audio apparatus according to the seventh invention, the apparatus further comprises a switching unit for selectively supplying at least the audio signal of the left channel and the audio signal of the right channel of the audio signal of the left channel and the audio signal of the right channel supplied to the input unit and the audio signal of the center channel to at least one output unit of the first output unit and the second output unit. In this manner, outputting operations of at least the audio signal of the left channel and the audio signal of the right channel can be easily selected by operating the switching unit.

BRIEF DESCRIPTION OF DRAWINGS

FIG. 2 is a diagram showing a configuration according to one embodiment of the present invention.

BEST MODE FOR CARRYING OUT THE INVENTION

Figure 1:
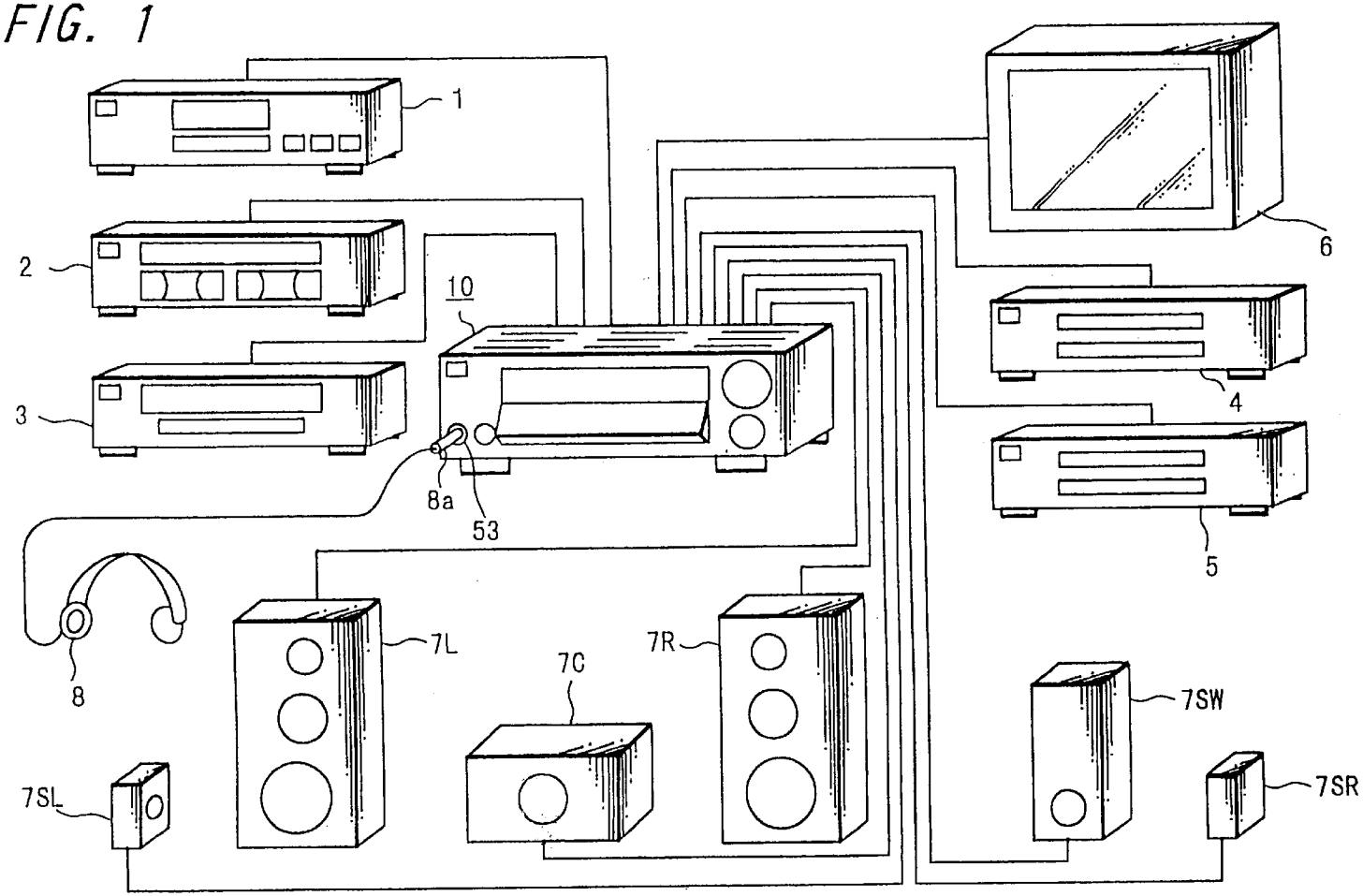
FIG. 1 is a block diagram showing an example of an amplifier apparatus according to one embodiment of the present invention.

One embodiment of the present invention will be described below with reference to the accompanying drawings.

In this embodiment, for example, the present invention is applied to an amplifier apparatus which can perform an advanced process of audio signals synchronized with video images and audio signals which are not related to video images. A configuration of a stereo apparatus to which an amplifier apparatus according to the present invention is connected will be described below with reference to FIG. 1. To the amplifier apparatus 10 according to the present invention, a disc reproducing apparatus 1 for reproducing audio signals from an optical disc called a compact disc (CD) as an audio apparatus for reproducing audio signals, a tape recording/reproducing apparatus 2 for using a magnetic tape of a tape cassette to record and reproduce audio signals, and a disc recording/reproducing apparatus 3 for using a recordable optical disc such as a photomagnetic disc to record and reproduce audio signals are connected. The audio signals reproduced from the respective recording media by the apparatuses 1, 2, and 3 are supplied to the amplifier apparatus 10.

To the amplifier apparatus 10, as a video device for reproducing video signals and audio signals, a video disc reproducing apparatus 4 for reproducing video signals and audio signals from an optical disc called a DVD (Digital Video Disc or Digital Versatile Disc) or the like and a video tape recording/reproducing apparatus 5 for using a magnetic tape to record and reproduce video signals and audio signals are connected. The video signals and the audio signals reproduced from the recording media by the apparatuses 4 and 5 are supplied to the amplifier apparatus 10.

As a video device for televising video signals selected by the amplifier apparatus 10 from the video signals supplied from the video disc reproducing apparatus 4 and the reproducing apparatus 5 to the amplifier apparatus 10, a monitor image-receiver 6 is connected to the amplifier apparatus 10. In addition, as loudspeakers for reproducing audio signals selected by the amplifier apparatus 10 from the audio signals supplied to the amplifier apparatus 10, front loudspeakers 7L and 7R arranged on the front left and right, a center loudspeaker 7C arranged at the front center, rear loudspeakers 7SL and 7SR arranged on the rear left and right, and a super woofer 7SW arranged at an arbitrary position. The super woofer 7SW is a loudspeaker having a function of outputting a sound having a frequency lower than a preset frequency, e.g., 120 Hz. The other loudspeakers 7C, 7L, 7R, 7SL, and 7SR are ordinary loudspeakers for outputting sounds having frequencies higher than the frequency of the sound output from the super woofer 7SW. These loudspeaker apparatuses 7C, 7L, 7R, 7SL, 7SR, and 7SW are stationary loudspeaker apparatuses.

In the amplifier apparatus 10, for example, a headphone terminal unit 53 is arranged on a front-surface panel. When a plug 8*a* of a headphone apparatus 8 is inserted into and connected to the headphone terminal unit 53, a user can hear audio signals selected by the amplifier apparatus 10 by using the headphone apparatus 8.

As the audio signals supplied to the amplifier apparatus 10, audio signals of two left and right channels may be used, or audio signals of multi-channels which are larger in number than that of two channels may be used. As audio channels of a large number of channels, for example, signals of six channels (to be referred to as 5.1 channels hereinafter), i.e., a front left channel, a front right channel, a center channel, a rear left channel, a rear right channel, and a low-band frequency dedicated channel are used. The audio signals of the 5.1 channels are supplied to the amplifier apparatus 10, and processes such as separation and amplification are performed to the signals of the channels of the audio channels of the 5.1 channels. Thereafter, the signals are supplied to the loudspeakers 7C, 7L, 7R, 7SL, 7SR, and 7SW of the channels having the same arrangement and corresponding to the audio signals of the channels to output sounds. The audio signals of the 5.1 channels may also be supplied from another device. However, in the example shown in FIG. 1, the audio signals are one of digital audio signals supplied from, e.g., the video disc reproducing apparatus 4, and are RF-modulated audio signals obtained at an digital RF input unit 11 (to be described later).

A low-band dedicated channel existing when the digital audio signals of the 5.1 channels described above are used is a channel in which only an audio signal having a frequency lower than, e.g., about 120 Hz exists. A mode in which the low-band dedicated channel is called an LFE mode. In this embodiment, as the low-band dedicated channel, the audio signal having a frequency lower than about 120 Hz is set. However, the lower limit of the frequency of the audio signal is changed depending on a music source or the like recorded on a stereo apparatus or a recording medium. A digital audio signal in which a low-band dedicated channel exists in the LFE mode includes any identifier signal representing that the low-band dedicated channel exists. In multi-channel audio except for 5.1 channel digital audio, the same low-band dedicated channel may be used to set the LFE mode. When the audio signals of two channels are input to the amplifier apparatus 10, the input signals of the two channels are processed by the amplifier apparatus 10 to generate channel components of the rear left and right channels and the like, and the channels are supplied the above loudspeakers 7C, 7L, 7R, 7SL, 7SR, and 7SW of the channels to output sounds.

The internal configuration of the amplifier apparatus 10 will be described below with reference to FIG. 2. FIG. 2 is a block diagram showing a processing system of audio signals of the amplifier apparatus 10 and a control system of the processing system of the audio signals. The input unit for a digital audio signal included in the amplifier apparatus 10 has a digital RF input unit 11, two optical digital input units 12 and 13 to which optical fiber cables are connected and to which digital data are supplied, and a coaxial digital input unit 14 to which a coaxial cable is connected and to which digital data is supplied. The digital data obtained from the digital input units 11 to 14 are supplied to a change-over switch 22 controlled by a system controller 30. Under the control of the system controller 30, the change-over switch 22 selects digital data from one of the input units described above, and supplies the selected audio data to a digital signal processor (to be referred to as a DSP hereinafter) 23. In this case, the RF-modulated digital data obtained in the digital RF input unit 11 is demodulated in an RF demodulation unit 21, and then supplied to the change-over switch 22. This amplifier apparatus 10 comprises an output unit 15 for a digital audio signal, and supplies the digital data (e.g., digital data supplied to the DSP 23 may be used) selected by the change-over switch 22 and any digital data of the digital data from the other input units to an external electronic device connected to the output unit 15, so that recording or the like can be performed by the external electronic device.

As input units for analog audio signals, four analog input units 16, 17, 18, and 19 are arranged in the amplifier apparatus 10. Analog audio signals supplied through the analog input units 16 to 19 are supplied to a change-over switch 24 controlled by the system controller 30, the audio signal from one of the analog input units 16 to 19 is selected. The audio signal selected by the change-over switch 24 is converted into digital data, and then supplied to the DSP 23. This amplifier apparatus 10 comprises an output unit 20 for an analog audio signal, and supplies the audio data (e.g., an analog audio signal supplied to the DSP 23 may be used) selected by the change-over switch 24 and any analog audio signal of the analog audio signals from the other input units to an external electronic device connected to the output unit 20, so that recording or the like can be performed by the external electronic device.

In the DSP 23, required processes are performed to the audio data supplied through the switch 22. The processes performed by the DSP 23 are, for example, a surround process in which a sound field reproduced by audio signals of the channels is set to be an arbitrary sound field or set in an acoustic state, a process of converting the number of channels, a process of converting audio signals of, e.g., two channels into audio signals of 5.1 channels, and processes reverse thereto. These processes are digitally processed. The processes performed in the DSP 23 are performed on the basis of the control of the system controller 30.

A digital audio signal output from the DSP 23 is supplied to a digital/analog converter (DAC) 25 to be converted into an analog audio signal. A low-pass filter 26 removes a harmonic component, i.e., a high-frequency component from the analog audio signal output from the digital/analog converter (DAC) 25. Thereafter, the analog audio signal is supplied to an amplifier unit 27 and amplified by the amplifier unit 27. An output signal from the amplifier unit 27 is subjected by an output process such as a mute process by an output processing unit 28 as needed, and is supplied to two loudspeaker terminal units 51 and 52. In addition to the loudspeaker terminal units 51 and 52, a headphone terminal unit 53 is arranged in the amplifier apparatus 10. An audio signal processed to be heard by a headphone is supplied to the headphone terminal unit 53. Audible sounds based on the audio signals supplied from the loudspeaker terminal units 51 and 52 are output from the loudspeaker apparatuses 7, i.e., as shown in FIG. 1, the loudspeaker apparatuses 7L, 7R, 7C, 6SL, and 7SW of the respective channels, and an audible sound based on the audio signal supplied from the headphone terminal unit 53 is also output from the headphone apparatus 8 connected to the headphone terminal unit 53. The details of a configuration in which audio signals output from the output processing unit 28 are supplied to the respective terminal units 51, 52, and 53 will be described below.

The system controller 30 which controls the processes in the amplifier apparatus 10 is constituted by an arithmetic operation circuit called a microcomputer. An infrared signal from a remote control apparatus which received by an infrared signal receiving unit 31 and signals based on the operations of a tact key switch 32 operated by an operation button arranged on the front panel of the amplifier apparatus 10, a rotary encoder 33 connected to a dial thumbscrew arranged on the front panel of the amplifier apparatus 10, the system controller 30, and a master volume 34 are supplied to the system controller 30. The system controller 30 performs various settings based on the signals supplied from the switch 32, the encoder 33, and the volume 34 and control signal operations of the respective parts. The rotary encoder 33 is a rotary operation switch for performing input switching, i.e., function switching. The master volume 34 is a volume for adjusting the volumes of outputs from the loudspeaker apparatuses 7L, 7R, 7C, 7SL, 7SR, and 7SW or the headphone apparatus 8.

The amplifier apparatus 10 comprises a display unit 40 constituted by a fluorescent display tube or the like. A display control signal for controlling a display is supplied from the system controller 30 to a display drive circuit 35, so that a display operation in the display unit 40 is controlled by the system controller 30. In this case, an area in which arbitrary characters and numerals can be displayed and an area in which predetermined characters and graphics can be displayed are formed on the display unit 40. On the display unit 40, various operation states such as a function switching state and a surround process state are displayed with predetermined specific colors.

The details of a configuration in which the audio signals processed by the output processing unit 28 of the amplifier apparatus 10 according to the present invention are supplied to the terminal units 51, 52, and 53 to which the loudspeaker apparatuses 7L, 7R, 7SL, and 7SW or the headphone apparatus 8 are connected will be described below with reference to FIG. 3.

Terminals 50L, 50R, 50C, 50LFE, 50SL, and 50SR are terminals to which audio signals converted into analog signals by the digital/analog converter 25 of the amplifier apparatus 10, e.g., analog audio signals corresponding to outputs from the low-pass filter 26 in FIG. 2 are supplied. The audio signal of the front left channel is supplied to the terminal 50L, the audio signal of the front right channel is supplied to the terminal 50R, the audio signal of the center channel is supplied to the terminal 50C, the audio signal of the low-band dedicated channel is supplied to the terminal 50LFE, the audio signal of the rear left channel is supplied to the terminal SL, and the audio signal of the rear right channel is supplied to the terminal 50SR. The audio signals of the channels supplied to the terminals 50L, 50R, 50LFE, 50SL, and 50SR are supplied to terminals 51L, 51R, 51C, 51LFE, 51SL, and 51SR for the channels of the first loudspeaker terminal unit 51 through amplifier units 27L, 27R, 27C, 27LFE, 27SL, and 27SR (corresponding to the amplifier unit 27 in FIG. 2) arranged for the respective channels. In the amplifier units 27L, 27R, 27C, 27LFE, 27SL, and 27SR of the respective channels, amplification processes having relatively large outputs which can drive so-called stationary loudspeaker apparatuses, e.g., amplifications of about several ten to one hundred and several ten W are performed.

Here, an output signal from the amplifier unit 27L for the front left channel and an output signal from the amplifier unit 27R for the front right channel are supplied to the first loudspeaker terminal unit 51 through switches 59L and 59R. When these switches 59L and 59R are switched, the audio signals of the front left and right channels can also supplied to loudspeaker terminals 52L and 52R for the front left and right channels of the second loudspeaker terminal unit 52. The switches 59L and 59R are designed such that the supply of the audio signal to the first loudspeaker terminal unit 51 and the supply of the audio signal to the second loudspeaker terminal unit 52 can be independently selected. The switches 59L and 59R can also supply the audio signals to the loudspeaker apparatuses connected to both the terminal units 51 and 52 at once. However, the second loudspeaker terminal unit 52 is a terminal to which only loudspeaker apparatuses 7L' and 7R' of the two front left and right channels can be connected. FIG. 3 shows the example in which the loudspeaker apparatuses corresponding to the respective channels are connected to both the first loudspeaker terminal unit 51 and the second loudspeaker terminal unit 52. However, in fact, only the terminal unit of one of the systems may be used.

Switches 58L and 58R for making a branch to the headphone terminal unit 53 side are arranged on the input unit side of the amplifier unit 27L for the front left channel and the input unit side of the amplifier unit 27R for the front right channel. The details of switching processes in these switches 58L and 58R will be described later.

A configuration for branching audio signals supplied from the terminals 50L to 50R to the headphone terminal unit 53 side will be described below. The audio signals of the respective channels supplied through the terminals 50L, 50R, 50C, 50LFE, 50SL, and 50SR are branched to the system for the headphone terminal independently of the system on the loudspeaker terminal units 51 and 52 described above, and are subjected to a mixing process (e.g., an addition process in the example shown in FIG. 3) for making audio signals of two channels. More specifically, the audio signal of the front left channel supplied from the terminal 50L is supplied to a mixer 55L through a buffer amplifier 54L, the audio signal of the center channel supplied from the terminal 50C is supplied to the mixer 55L through a buffer amplifier 54C, and the audio signal of the center channel is mixed to the audio signal of the front left channel. The audio signal of the front right channel supplied from the terminal 50R is supplied to a mixer 55R through a buffer amplifier 54R, the audio signal of the center channel supplied from the terminal 50C is supplied to the mixer 55R through the buffer amplifier 54C, and the audio signal of the center channel is mixed to the audio signal of the front left channel.

The audio signal of the front left channel mixed with the audio signal of the center channel by the mixer 55L is supplied to a mixer 56L, the audio signal of the rear left channel supplied from the terminal 50SL is supplied to the mixer 56L through a buffer amplifier 54SL, and the audio signal of the rear left channel is mixed to the audio signal of the front left channel. The audio signal of the front right channel mixed with the audio signal of the center channel by the mixer 55R is supplied to a mixer 56R, the audio signal of the rear right channel supplied from the terminal 50SR is supplied to the mixer 56R through a buffer amplifier 54SR, and the audio signal of the rear right channel is mixed to the audio signal of the front right channel.

In addition, the audio signal of the left channel mixed with the audio signal of the rear channel by the mixer 56L is supplied to a mixer 57L, the audio signal of the low-band dedicated channel supplied from the terminal 50LFE is supplied to the mixer 57L through a buffer amplifier 54LFE, and an audio signal consisting of a low-frequency component is mixed to the audio signal of the left channel. The audio signal of the right channel mixed with the audio signal of the rear channel by the mixer 56R is supplied to a mixer 57R, the audio signal of the low-band dedicated channel supplied from the terminal 50LFE is supplied to the mixer 57R through the buffer amplifier 54LFE, and an audio signal consisting of a low-frequency component is mixed to the audio signal of the right channel.

The audio signal of the left channel mixed by the mixer 57L is supplied to an amplifier unit 27HL of the left channel for the headphone through the switch 58L, and the audio signal of the left channel for the headphone amplified by the amplifier unit 27HL is supplied to a left-channel terminal 53L of the headphone terminal unit 53. The audio signal of the right channel mixed by the mixer 57R is supplied to an amplifier unit 27HR of the right channel for the headphone through the switch 58R, and the audio signal of the right channel for the headphone amplified by the amplifier unit 27HR is supplied to a right-channel terminal 53R of the headphone terminal unit 53. In the amplifier units 27HL and 27HR for the headphone, amplification processes having relatively small outputs which can drive small loudspeaker units built in the headphone apparatus 8, e.g., amplifications of about several to several ten mW are performed.

The switches 58L and 58R arranged on the previous stages of the amplifier units 27HL and 27HR for the headphone are switches for the audio signals which are mixed by the mixers 55L, 55R, 56L, 56R, 57L, and 57R, the audio signals which are not mixed, i.e., the audio signals supplied from the terminals 50L and 50R to be interlocked with each other. Therefore, when the switches 58L and 58R are switched, as the audio signals amplified by the amplifier units 27HL and 27HR for the headphone, the audio signal obtained by mixing other channel components to the front left and right channels and the audio signal consisting of only the front left and right channel components can be selected. Depending on the switching states of the switches 58L and 58R, audio signals of two channels mixed by the mixers 55L, 55R, 56L, 56R, 57L, and 57R can also be supplied to the loudspeaker terminal units 51 and 52 in place of the audio signals of the two front channels obtained by the terminals 50L and 50R. The switching operations of the switches 58R, 58L, 59R, and 59L may be performed by the operation of the change-over switches of the front panel of the amplifier apparatus 10, or the switches 58R, 58L, 59R, and 59L may be switched to be interlocked with the operation of a mode switching operation unit, for a reproduction mode, arranged on the front panel of the amplifier apparatus 10.

Figure 3:
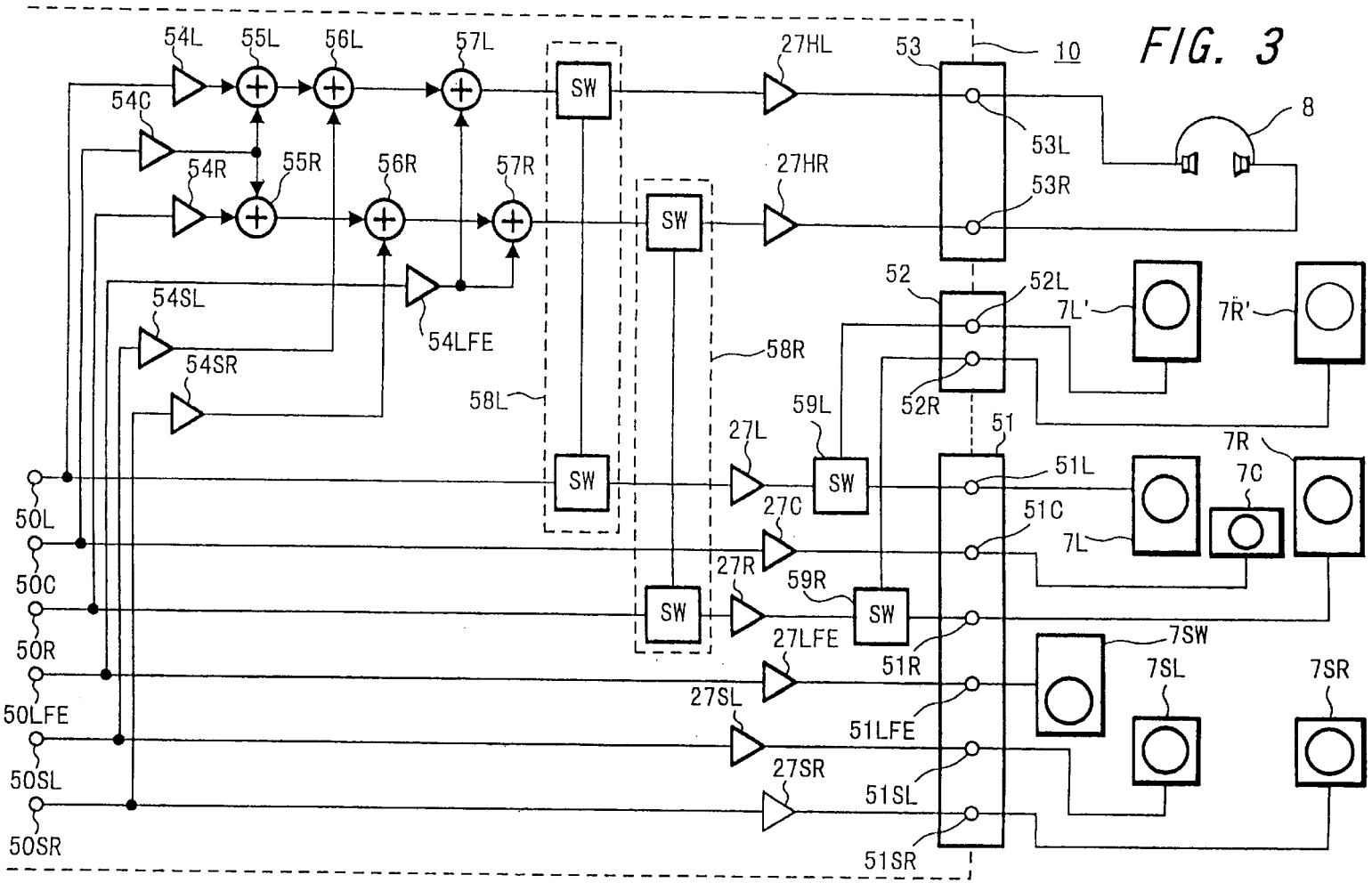
FIG. 3 is a diagram showing an audio signal output unit according to one embodiment of the present invention.

In the configuration shown in FIG. 3, a basic output processing configuration for an audio signal is shown. The configuration for a muting process is omitted.

When the output processing unit 28 of an audio signal is constituted as described above, both a reproduction output of the audio signals from the stationary loudspeaker apparatuses 7L', 7R' to 7L, 7R, 7C, 7SW, 7SL, and 7SR connected to the loudspeaker terminal units 51 and 52 and a reproduction output of an audio signal from the headphone apparatus 8 connected to the headphone terminal unit 53 can be preferably performed. In particular, as a process selected by switching in the switches 58L and 58R, the audio signals supplied to the loudspeaker terminal units 51 and 52 are used as the audio signals of the front left and right channels obtained by the terminals 50L and 50R, and the audio signals supplied to the headphone terminal unit 53 are used as the audio signals of the left and right channels mixed with the audio signals of the other channels by the mixers 55L, 55R, 56L, 56R, 57L, and 57R. In this manner, sounds which can reproduce a sound field based on multi-channel audio signals are output from the loudspeaker apparatuses 7L, 7R, 7C, 7SW, 7SL, and 7SR connected to the first loudspeaker terminal unit 51, and sounds based on the audio signals obtained by mixing the components of other channels to the audio signals of the two left and right channels are output from the headphone apparatus 8 connected to the headphone terminal unit 53. Therefore, when multi-channel audio serving as speech of a movie reproduced from a video disc or the like is output, a sound field obtained by proper stereo acoustic sounds can be reproduced from the loudspeaker apparatuses 7L, 7R, 7C, 7SW, 7SL, and 7SR, and reproduced sounds based on audio signals including all words, sound effects, and low-band sounds can be heard with the headphone apparatus 8.

In this case, the output processing unit 28 can simultaneously output outputs based on the multi-channel audio signals from the loudspeaker apparatuses 7L, 7R, 7C, 7SW, 7SR, and 7SL and outputs based on the audio signals two synthesized channels from the headphone apparatus 8. For example, in the state in which sounds based on audio signals are output from the loudspeaker apparatuses, the plug of the headphone apparatus 8 is inserted into the headphone terminal unit 53, and only a switch operation for stopping outputting of sounds from the loudspeaker apparatuses 7L, 7R, 7C, 7SW, 7SR, and 7SL arranged on the front panel of the amplifier apparatus is performed, so that the multi-channel audio signals can be heard with the headphone apparatus 8. In this case, a user need not perform a mode setting for switching the process states of supplied multi-channel audio signals according to hearing using the headphone apparatus 8 at all, and the user can easily perform switching between a hearing state in which the loudspeaker apparatuses 7L to 7SL are used and a hearing state in which the headphone apparatus 8 is used. In a state in which reproduced sounds based on multi-channel audio signals are output from the loudspeaker apparatuses 7L to 7SL of the respective channels, and, at the same time, sounds based on audio signals synchronized in two channels can be heard from the headphone apparatus 8.

In the amplifier apparatus described above, the audio signals of the center channel and the rear left and right channels and the audio signal of the low-band dedicated channel are mixed to the audio signals of the two front left and right channels to output the mixed audio signals from the headphone terminal unit. However, only the audio signal of one of the other channels constituting the multi-channel may be mixed to the audio signals of the two front left and right channels. For example, only the audio signal of the center channel may be mixed to the audio signals of the two front left and right channels, and the mixed audio signals of the two channels may be supplied to the headphone terminal unit. In this manner, when speech of, e.g., a movie is opened by using a headphone apparatus, the audio signal of a center channel including at least words are mixed to the audio signals of left and right channels. For this reason, the words are output from the left and right loudspeaker units of the headphone apparatus.

In addition, the audio signal of the center channel may be mixed to the two front left and right channels, and the rear left and right channels may be mixed to the two front left and right channels. In this manner, sound effects included to the rear channel can be output from the headphone apparatus.

In the example described above, signals supplied from a video disc reproducing apparatus to an amplifier apparatus are used as multi-channel audio signals of 5.1 channels or the like. However, multi-channel audio signals supplied from another video device or an audio device, e.g., multi-channel audio signals obtained by satellite broadcast waves received by a tuner may be processed.

In the example described above, audio signals constituted by 5.1 channels are used as multi-channel audio signals. However, audio signals of three or more other channels may be used.

In addition, in the example described above, the present invention is applied to the process in an audio device called an AV amplifier apparatus. However, the present invention can also be applied to the case in which the same process described above is performed by an audio device integrated with another audio device such as a system stereo apparatus.

What is claimed is:

1. An audio signal processing apparatus comprising:

an input unit to which at least an audio signal of a front left channel, an audio signal of a rear left channel, an audio signal of a front right channel, an audio signal of a rear right channel, an audio signal of a low band dedicated channel, and an audio signal of a center channel are supplied;

a first output terminal unit for outputting the audio the signals supplied to the input unit;

a mixing unit for: mixing the audio signal of the center channel to the audio signals of the front left channel and the rear left channel, for mixing the audio signal of the center channel to the audio signals of the front right channel and the rear right channel, for mixing the audio signal of the low band dedicated channel to the mixed audio signal of the center channel and the front left and rear left channels, and for mixing the audio signal of the low band dedicated channel to the mixed audio signal of the center channel and the front right and rear right channels, to output mixed audio signals of two channels; and a second output terminal unit for outputting the mixed audio signals of the two channels from the mixing unit.

2. The audio signal processing apparatus according to claim 1, further comprising a switching unit for selectively supplying the audio signal of the front left channel and the audio signal of the front right channel to the second output terminal unit or the mixed audio signals of the two channels from the mixing unit to the second output terminal unit.

3. The audio signal processing apparatus according to claim 2, wherein the switching unit selectively supplies the audio signal of the front left channel and the audio signal of the front right channel to the first output terminal unit and the mixed audio signals of the two channels from the mixing unit to the second output terminal unit.

4. An audio apparatus comprising:

an input unit to which at least an audio signal of a front left channel, an audio signal of a rear left channel, an audio signal of a front right channel, an audio signal of a rear right channel, an audio signal of a low band dedicated channel, and an audio signal of a center channel are supplied;

a first output terminal unit connected to a plurality of loudspeaker apparatuses for outputting at least the audio signals supplied to the input unit;

a mixing unit for: mixing the audio signal of the center channel to the audio signals of the front left channel and the rear left channel, for mixing the audio signal of the center channel to the audio signals of the front right channel and the rear right channel, for mixing the audio signal of the low band dedicated channel to the mixed audio signal of the center channel and the front left and rear left channels, and for mixing the audio signal of the low band dedicated channel to the mixed audio signal of the center channel and the front right and rear right channels, to output mixed audio signals of two channels; and a second output terminal unit to output the audio signals of the two channels from the mixing unit and to which a headphone apparatus is connected.

5. The audio apparatus according to claim 4, further comprising a switching unit for selectively supplying the audio signal of the front left channel and the audio signal of the front right channel to the second output terminal unit and the audio signals of the two channels from the mixing unit to the second output terminal unit.

6. The audio apparatus according to claim 5, wherein the switching unit selectively supplies the audio signal of the front left channel and the audio signal of the front right channel supplied to the first output terminal unit and the audio signals of the two channels from the mixing unit to the second terminal unit.

7. The audio apparatus according to claim 4, wherein said first output terminal unit comprises:

a first output unit for outputting at least one of the audio signal of the front left channel and the audio signal of the rear left channel, at least one of the audio signal of the front right channel and the audio signal of the rear right channel, and the audio signal of the center channel; and a second output unit for outputting at least one of the audio signal of the front left channel and the audio signal of the rear left channel, at least one of the audio signal of the front right channel and the audio signal of the rear right channel, and the audio signal of the center channel.

8. The audio apparatus according to claim 7, further comprising a switching unit for selectively supplying at least one of the audio signal of the front left channel and the audio signal of the rear left channel, at least one of the audio signal of the front right channel and the audio signal of the rear right channel, and the audio signal of the center channel to at least one output unit of the first output unit and the second output unit.

* * * * *